United States Patent [19]

Norwood

[11] Patent Number: 4,573,102

[45] Date of Patent: Feb. 25, 1986

[54] ELECTRICALLY ILLUMINATED ARTIFICIAL TREE

[76] Inventor: Dorothy Norwood, 15701 Morning Star, Maple Heights, Ohio 44137

[21] Appl. No.: 557,862

[22] Filed: Dec. 5, 1983

[51] Int. Cl.[4] ..... F21P 1/02

[52] U.S. Cl. ..... 362/123; 362/249; 362/252; 362/806

[58] Field of Search ..... 362/123, 249, 252, 806

[56] References Cited

U.S. PATENT DOCUMENTS

| | | | |
|---|---|---|---|
| 2,453,695 | 11/1948 | Belling | 362/806 X |
| 3,118,617 | 1/1964 | Hellrich | 240/10 |
| 3,206,593 | 9/1965 | Winnicki, Sr. | 240/10 |
| 3,296,430 | 1/1967 | Eckert | 240/10 |
| 3,571,586 | 3/1971 | Duckworth | 240/10 |
| 3,617,732 | 11/1971 | Fisher | 240/10 |
| 3,655,495 | 4/1972 | Carrell | 161/16 |
| 4,364,102 | 12/1982 | Huppert | 362/249 X |

*Primary Examiner*—Peter A. Nelson

*Attorney, Agent, or Firm*—Porter & Bremer Co.

[57] ABSTRACT

An electrically illuminated artificial tree is disclosed herein having a trunk body member and a plurality of branch receiving receptacles disposed thereon. A plurality of branches, having a male plug disposed on one end, are inserted into the receptacles and are held therein. A support member is provided and is attached to an end of the trunk body member and provides a supply of electrical current thereto. A plurality of electrically connected illuminating members and leaf members are provided on the branches to provide the simulated appearance of an illuminated natural tree.

8 Claims, 6 Drawing Figures

ELECTRICALLY ILLUMINATED ARTIFICIAL TREE

BACKGROUND OF THE INVENTION

1. Field of the Invention

This invention relates to artifical trees and, more particularly, to an electrically illuminated artifical holiday tree wherein the electrical connections are internally disposed within the tree to allow for ease in assembly and maintenance.

2. Description of the Prior Art

Electrically illuminated artificial trees have been well known for a long period of time and have particularly enjoined great popularity in use over the Christmas holidays in most of the developed countries throughout the western hemisphere. Normally, a person wishing to decorate and illuminate such a tree must externally place a string, or strings, of colored lights throughout the branches of the tree in order to adequately illuminate the many branches thereof. Because of the cost of manufacture, and the length of the wires which connect the numerous colored lights, such holiday lighting is often exceedingly expensive and somewhat cumbersome to effectively use in decorating the tree. Further, such external lighting has been known to cause household fires and provide a potentially dangerous environment, especially where the string of lights has been used over a number of years causing the wearing of the insulation which covers the wires thereby exposing the wires, and electrical currents contained therein, to the artificial branches of the tree, as well as other flammable materials.

Recent developments in this field of art have attempted to provide Christmas trees with a relatively safe wiring configuration for the lamps disposed thereon. Representative of these well-known trees are those described in U.S. Pat. Nos. 3,118,617; 3,206,593; 3,296,430; 3,571,586; and 3,617,732. None of these configurations, however, provide a holiday type tree which effectively has a plurality of illuxinated lamps intersperse throughout the numerous branches thereof.

SUMMARY OF THE INVENTION

In overcoming the aforementioned problems and drawbacks, the present invention provides a unique and novel configuration which is easily assembled and which internally contains the requisite wiring necessary to illuminate the lamps interspersed throughout the tree branches and connect them to a current supply.

A primary objective of the present invention is to provide a novel electrically illuminated artificial holiday or Christmas tree which has the overall appearance of a real tree and, further, has a plurality of illuminated lamps interspersed throughout the various branches thereof.

Another object of the present invention is to provide a holiday type tree which has substantially all of the current carrying wires for illuminating the lamps internally positioned within the tree and branches to minimize the fire hazard exterior potential of the tree.

In accordance with an aspect of the present invention an electrically illuminated artificial tree is herewith disclosed and includes a trunk body member having a plurality of branch receiving means positioned thereon and a plurality of tree branches having connecting means in physical and electrical engagement therewith. The tree branches are further provided with a plurality of illuminating members and leaf members with a means for electrically connecting the illuminating members to the connecting means. A support means is also provided for supporting the trunk body member and has a means for supplying electrical current and a means for electrically connecting the branch receiving means to the means for supplying electrical current.

BRIEF DESCRIPTION OF THE DRAWINGS

The foregoing and other objects, advantages and characterizing features of the present invention will become clearly apparent from the ensuing detailed description of an illustrative embodiment thereof, taken together with the accompanying drawings wherein like reference numerals denote like parts throughout the various views and in which.

DETAILED DESCRIPTION OF THE PREFERRED EMBODIMENT

Figure 1:
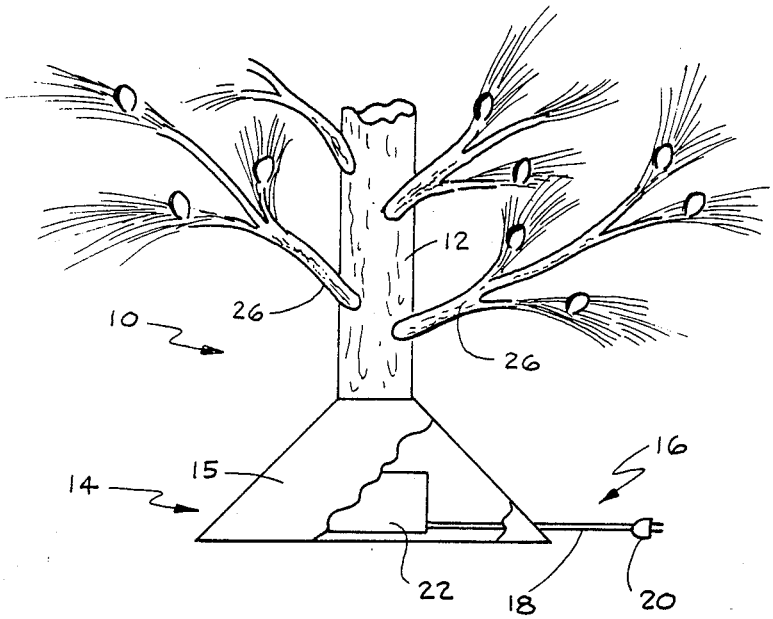
FIG. 1 is a partial front view, with portions broken away, of an assembled artificial tree according to the teachings of the present invention.

Referring now in detail to FIGS. 1 through 6, there is shown an electrically illuminated artificial holiday tree 10, according to the teachings of the present invention, wherein the tree 10 includes a trunk body member 12 having a support means 14 attached at the bottom thereof. The support means 14 consists of a base 15 having a means for supplying electrical current 16 to the tree 10. This means for supplying 16 normally includes adequate wiring 18 and a male wall outlet plug 20 which can be plugged into any conventional household wall outlet (not shown). In order to provide low voltage to the tree 10, a transformer 22 can also be positioned within the support means 14 to step down the voltage of the incoming household current from the wall outlet (not shown) to a relatively low voltage.

Figure 2:
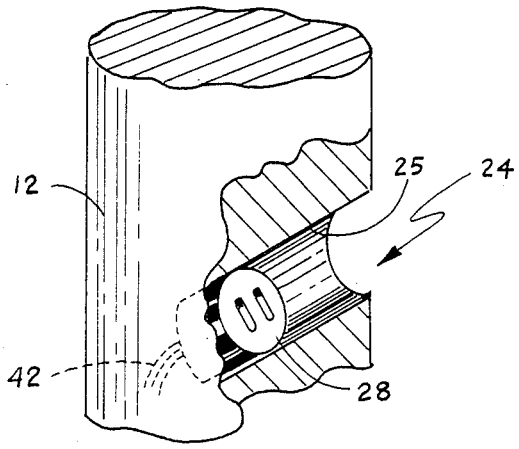
FIG. 2 is a side sectional view, with portions broken away, of a branch receiving means of the present invention.
Figure 3:
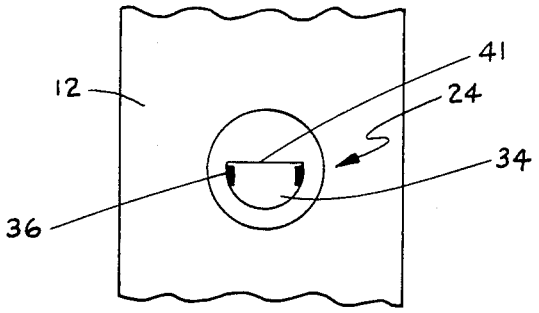
FIG. 3 is a front view, with portions broken away, of another embodiment of the branch receiving means of the present invention.
Figure 4:
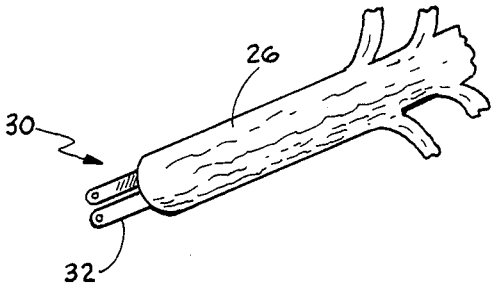
FIG. 4 is a perspective view, with portions broken away, of a connecting means capable of physical and electrical engagement with the receiving means of FIG. 2.
Figure 5:
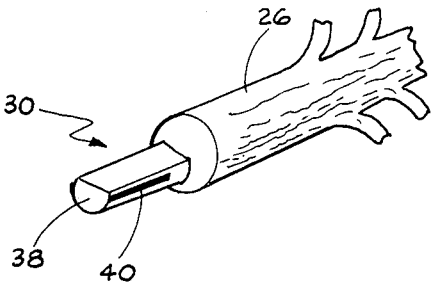
FIG. 5 is a perspective view, with portions broken away, of a connecting means capable of physical and electrical engagement with the receiving means of FIG. 3.

The trunk body member 12 is further provided with a plurality of branch receiving means 24, as particularly shown in FIGS. 2 and 3 which can be positioned in a recess 25 and in an angled relationship to the trunk body member 12. The recess 25 can be of varying depth and provides an inexpensive yet effective means for supporting tree branches 26 inserted therein. As is particularly shown in FIG. 2, a recessed receptacle member or one type of female plug 28 is positioned to receive a connecting means 30 positioned on the end of branch 26. The connecting means 30 has a type of male plug 32 which is particularly designed to engage female plug 28. This connection is provided to electrically connect the tree branch 26 to the branch receiving means 24 as described hereinabove. An alternative embodiment of the branch receiving means 24, and connecting means 30, is shown in FIGS. 3 and 4. FIG. 3 shows an alternative female outlet 34 which includes electrical leads 36 positioned on the inner periphery thereof. The connecting means 30, provided on the end of branch 26, is provided with a male plug 38 having electrical leads 40 positioned on an outer periphery thereof, which upon sliding engagement of the male plug 38 into female plug 34, come into physical and electrical contact with electrical leads 36. The female plug 34 is further provided with surface 41 which restricts the orientation of male plug 38 relative to the female plug 34 and inherently provides a safety precaution to prevent inappropriate insertion of other types of male plugs. The branch receiving means 24 is further provided with a means for electrically connecting the branch receiving means 24 to the electrical current supplied at the support base 14, with the means being wires 42 which are internally positioned within trunk body member 12 and connect the branch receiving means 24 in series. The wires 42 allow the current to flow from support base 14 through trunk body member 12 to branch receiving means 24. An electrical and physical connection between branch receiving means 24 and connecting means 30 is provided upon full insertion of the branch 26 into recess 25.

Figure 6:
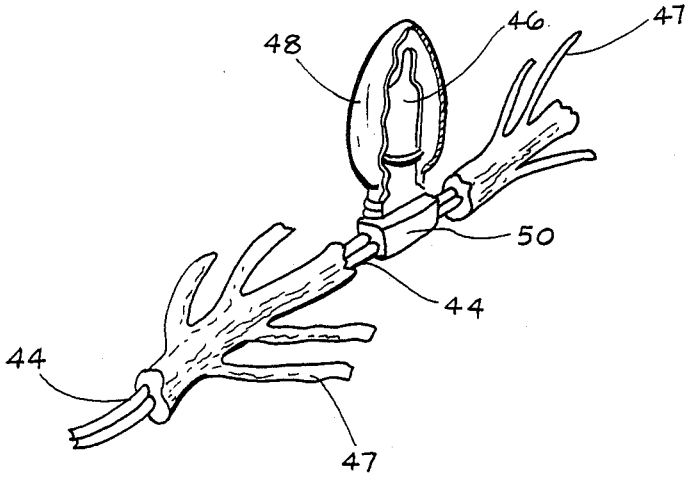
FIG. 6 is a cross-sectional view, with portions broken away, of a tree branch showing the wiring, in detail, of an illuminating member positioned thereon.

As shown in FIG. 6, a portion of a typical branch 26 is shown in detail, and includes electrically insulated wires 44, which are a means for electrically connecting the connecting means 30 to the illuminating members 46. The branch 26 is further provided with a plurality of leaf members 47 arranged in a fashion along branch 26 which simulates a leaf arrangement of a natural tree. The illuminating members 46, or lamps, can optionally include a colored outer surface 48 for coloring the light emitted therefrom. These illuminating members 46 can be connected to wires 44 by a variety of well-known connecting configurations which can include a base 50, but are preferably connected in series and in such a manner as to allow electrical current to flow throughout branch 26 when one or more illuminating members 46 have been disconnected or damaged.

In operation, a tree trunk body member 12, which can be made of plastic or other durable material, comes assembled with a plurality of branch receiving means 24 positioned thereon. A support means 14 having a transformer 22 and a means for supplying electrical current 16 is attached to an end thereof. All wires 42, except adequate wiring 18 for receiving electrical current from a typical wall plug (not shown), are contained within support means 14 and trunk body member 12. A plurality of branches 26 are subeequently inserted into the branch receiving means 24. Upon supplying electrical current via plug 20, a low voltage current is supplied, via transformer 22, through wires 42 into branch receiving means 24. Upon insertion of branches 26 into the branch receiving means 24, the electrical current passes into connecting means 30, and, subsequently, through wires 44 into lamps 46, causing their illumination. In this manner, a simple yet effective construction has been provided which enables an electrically illuminated artificial tree to be manufactured and easily assembled without any external wiring disposed thereon.

From the foregoing, it is apparent that the objects of the present invention have been fully accomplished. As a result of the present invention a new and improved electrically illuminated artifical tree has been disclosed. A preferred embodiment of the principles of this invention having been described and illustrated, it is to be realized that the same are not limited to the particular illuminated tree configuration shown in the drawings, and that modifications thereof are contemplated and can be made without departing from the spirit and scope of this invention as defined in the appended claims.

What is claimed is:

1. An electrically illuminated artificial tree comprising:

a trunk body member having a plurality of angularly recessed branch receiving means positioned thereon;

a plurality of tree branches, each including a plurality of illuminating members and leaf members located at spaced intervals along the tree branches, a connecting means positioned at an end of the tree branches for electrically engaging said branch receiving means, and a means for electrically connecting said illuminating members to said connecting means;

a support means having a means for supplying electrical current to said trunk body member and a means for electrically connecting said branch receiving means to said means for supplying electrical current, the means for electrically connecting including a plurality of insulated wires circuitously attached to the illuminating members, branch receiving means, and the means for supplying electrical current.

2. An electrically illuminated artificial tree as defined in claim 1, wherein said branch receiving means comprises a recessed receptacle member whereby said tree branch can be inserted therein.

3. An electrically illuminated artificial tree as defined in claim 1, wherein said illuminating member comprises a lamp.

4. An electrically illuminated artificial tree as defined in claim 1, wherein said connecting means for electrically engaging said branch receiving means includes a male plug member insertable in said branch receiving means.

5. An electrically illuminated artificial tree as defined in claim 1, wherein said branch receiving means and said illuminating members are electrically connected in series.

6. An electrically illuminated artificial tree as defined in claim 1, wherein said support means comprises a support member attached to an end of said trunk body member to provide support thereto.

7. An electrically illuminated artificial tree as defined in claim 6, wherein said support means has a transformer disposed therein which is electrically connected to said branch receiving means and said means for supplying electrical current.

8. An electrically illuminated artifical tree as defined in claim 1, wherein said trunk body member and said support means consists substantially of plastic.

* * * * *